United States Patent [19]

Auberon et al.

[11] Patent Number: 5,018,638

[45] Date of Patent: May 28, 1991

[54] RECEPTACLE FOR THE STORAGE OF FLUID UNDER PRESSURE

[75] Inventors: Marcel Auberon, Le Haillan; Albert Phan, St-Aubin, both of France

[73] Assignee: Societe Anonyme Dite: Aerospatiale Societe Nationale Industrielle, Paris, France

[21] Appl. No.: 336,129

[22] Filed: Apr. 11, 1989

[30] Foreign Application Priority Data

Apr. 27, 1988 [FR] France ..... 88 05618

[51] Int. Cl.[5] ..... B65D 1/16

[52] U.S. Cl. ..... 220/414; 220/590

[58] Field of Search ..... 220/3, 414

[56] References Cited

U.S. PATENT DOCUMENTS

| | | | |
|---|---|---|---|
| 2,744,043 | 5/1956 | Ramberg | 220/414 X |
| 2,848,133 | 8/1958 | Ramberg | 220/3 |
| 3,047,191 | 7/1962 | Young | 220/414 X |
| 3,112,234 | 11/1963 | Krupp | 220/3 X |
| 3,137,405 | 6/1964 | Gorcey | 220/414 X |
| 3,303,079 | 2/1967 | Carter | 220/414 X |
| 3,321,101 | 5/1967 | Griffith | 220/414 X |
| 3,358,867 | 12/1967 | Skinner | 220/414 X |
| 3,508,677 | 4/1970 | Laibson et al. | 220/3 |
| 3,815,773 | 6/1974 | Duvall et al. | 220/414 X |
| 3,843,010 | 10/1974 | Morse et al. | 220/3 |
| 3,907,149 | 9/1975 | Harmon | 220/414 X |
| 4,391,301 | 7/1983 | Pflederer | 220/414 X |
| 4,438,858 | 3/1984 | Grover | 220/414 X |
| 4,619,374 | 10/1986 | Yavorsky | 220/414 |
| 4,778,073 | 10/1988 | Ehs | 220/414 X |
| 4,785,956 | 11/1988 | Kepler et al. | 220/414 X |
| 4,905,856 | 3/1990 | Krogager | 220/414 X |

FOREIGN PATENT DOCUMENTS

| | | |
|---|---|---|
| 0191655 | 8/1986 | European Pat. Off. . |
| 1072420 | 6/1967 | United Kingdom . |

OTHER PUBLICATIONS

Design Engineering, vol. 51, No. 8, (Aug. 1980), p. 13.

*Primary Examiner*—Steven M. Pollard

*Attorney, Agent, or Firm*—Fisher, Christen & Sabol

[57] ABSTRACT

The present invention concerns a receptacle for the storage of fluid under pressure and comprising an internal casing with axis X,X' and having one central cylindrical section and two extremity sections, an armouring encompassing said casing and leaving clear at the convex extremity section a cap centered on axis X,X'.

According to the invention, the outer contour (8) of said convex extremity section (2b) of the casing (2) has, as a longitudinal section, a shape which is at least approximately elliptical so that the ratio G of the small half axis to the major axis is such that:

$$0.32 \leqq G \leqq 0.4 \qquad \text{(I)}$$

where the major axis corresponds to the outer diameter of the central cylindrical section (2a) of the casing (2), and the thickness $e_i$ of said convex extremity section (2b), said cap (6) being excluded, varies according to the formula:

$$e_i = \frac{e_1 - e}{R - R_1}(R - R_i) + e \qquad \text{(II)}$$

in which:

$R_i$=distance to the axis X,X' of the point of the outer contour (8) of said convex extremity section (2b) at which the thickness $e_i$ is measured, e=thickness of the casing (2) at its central cylindrical section (2a), R=external radius of the central cylindrical section (2a), $R_1$=radius of the base of said cap (6), and $e_1$=thickness of the casing (2) for $R_i=R_1$, the thickness of said cap (6) being at least equal to $e_1$.

The invention is applicable more particularly to gas cylinders.

10 Claims, 3 Drawing Sheets

RECEPTACLE FOR THE STORAGE OF FLUID UNDER PRESSURE

FIELD OF THE INVENTION

The present invention concerns a receptacle for the storage of fluid under pressure.

BACKGROUND OF THE INVENTION

More particularly, although not exclusively, the invention relates to receptacles, known as "cylinders", for the storage of gases, such as air, oxygen, nitrogen and carbon dioxide used in various industrial sectors.

Via the document U.S. Pat. No. 3,508,677, such a receptacle is known to already exist for storing gases under pressure and generally includes an internal case having one central cylindrical section and two convex extremity sections, and an armouring of resistant fibers coated with a hardenable bonding material encompassing said casing.

In this case, the casing has a constant thickness, both as regards the central cylindrical section and the two convex extremity sections.

However, and having regard to the differences of stresses between the central section and the extremity sections, in order to obtain sound resistance of the receptacle, such a constant thickness implies that the central section must have excessive thickness with respect to what would be required. This necessarily results in there being an "excess weight" of the receptacle which is particularly disadvantageous when such receptacles are intended to be used in space missiles or to be carried on the back of a man (diving cylinders, for example).

SUMMARY OF THE INVENTION

The object of the present invention is to overcome this drawback and concerns a receptacle for the storage of fluid under pressure and adapted to provide the best possible weight/resistance ratio.

To this effect, the receptacle for the storage of fluid under pressure is of the type including an internal casing with a form of revolution around a longitudinal axis X, X' and having one central cylindrical section and two extremity sections, at least one of said extremity sections bulging outwards, an armouring of resistant fibers coated with a hardenable bonding material encompassing said casing and having at least one planetary winding leaving clear on said convex extremity section a cap centered on said axis X, X', said receptacle according to the invention being notable in that the outer contour of said extremity section of the casing has, as a longitudinal section, at least an approximately elliptic shape so that the ratio G of the small half axis to the major axis is such that:

$$0.32 \leqq G \leqq 0.4 \qquad \text{(I)}$$

where the major axis corresponds to the outer diameter of the central cylindrical section of the casing and in that the thickness $e_i$ of said convex extremity section of the casing, said cap being excluded, varies according to the formula:

$$e_i = \frac{e1 - e}{R - R_1}(R - R_i) + e \qquad \text{(II)}$$

in which:

$R_i$ = distance to the axis X, X' of the point of the outer contour of said convex extremity section at which the thickness $e_i$ is measured, e = thickness of casing at its central cylindrical section, R = outside radius of the central cylindrical section of the casing, $R_1$ = radius of the base of said cap, and $e_1$ = thickness of the casing for $R_i = R_1$, the thickness of said cap being equal to at least $e_1$.

Accordingly, the receptacle according to the invention presents the best possible weight/resistance ratio since it does not comprise any excess thickness in the central cylindrical section of the casing. Moreover, the elliptical shape of the convex extremity sections makes it possible to obtain greater volume compared, say, with a hemispherical shape, for a given length, namely a given spatial requirement, of the receptacle. Moreover, this elliptical shape provides an improved base plate for the planetary winding.

In partiular, said ratio G is such that:

$$0.34 \leqq G \leqq 0.35$$

Advantageously, the inner contour of said convex extremity section of the casing has, as a longitudinal section, a shape which is at least almost elliptical.

According to a further characteristic of the invention, the two extremity sections of the casing are bulged outwards, at least one of said sections being provided with a filler neck.

Again, according to another characteristic of the invention, one extremity section of the casing has a neck and, at least on the periphery of said extremity section, the outer contour of the latter has, as a longitudinal section, a shape at least almost elliptical according to the formula (I) and, at least on said periphery, the thickness of said extremity section varies according to the formula (II).

Advantageously, at least on the periphery of said extremity section containing the neck, the internal contour of the latter has, as a longitudinal section, a shape which is at least almost elliptical.

In the case where the receptacle has a suitably made neck, said armouring rests on said neck.

According to another characteristic of the invention, said armouring comprise at least one circumferential winding on said planetary winding in correspondence with at least the central cylindrical section of the casing.

In particular, said armouring is constituted by an alternation of planetary windings and circumferential windings.

Moreover, said casing may be made of metal, for example aluminium.

BRIEF DESCRIPTION OF THE DRAWINGS

The figures of the attached drawing clearly show how the invention may be embodied. Identical references on these figures denote similar elements.

DETAILED DESCRIPTION OF THE PREFERRED EMBODIMENTS

Figure 1:
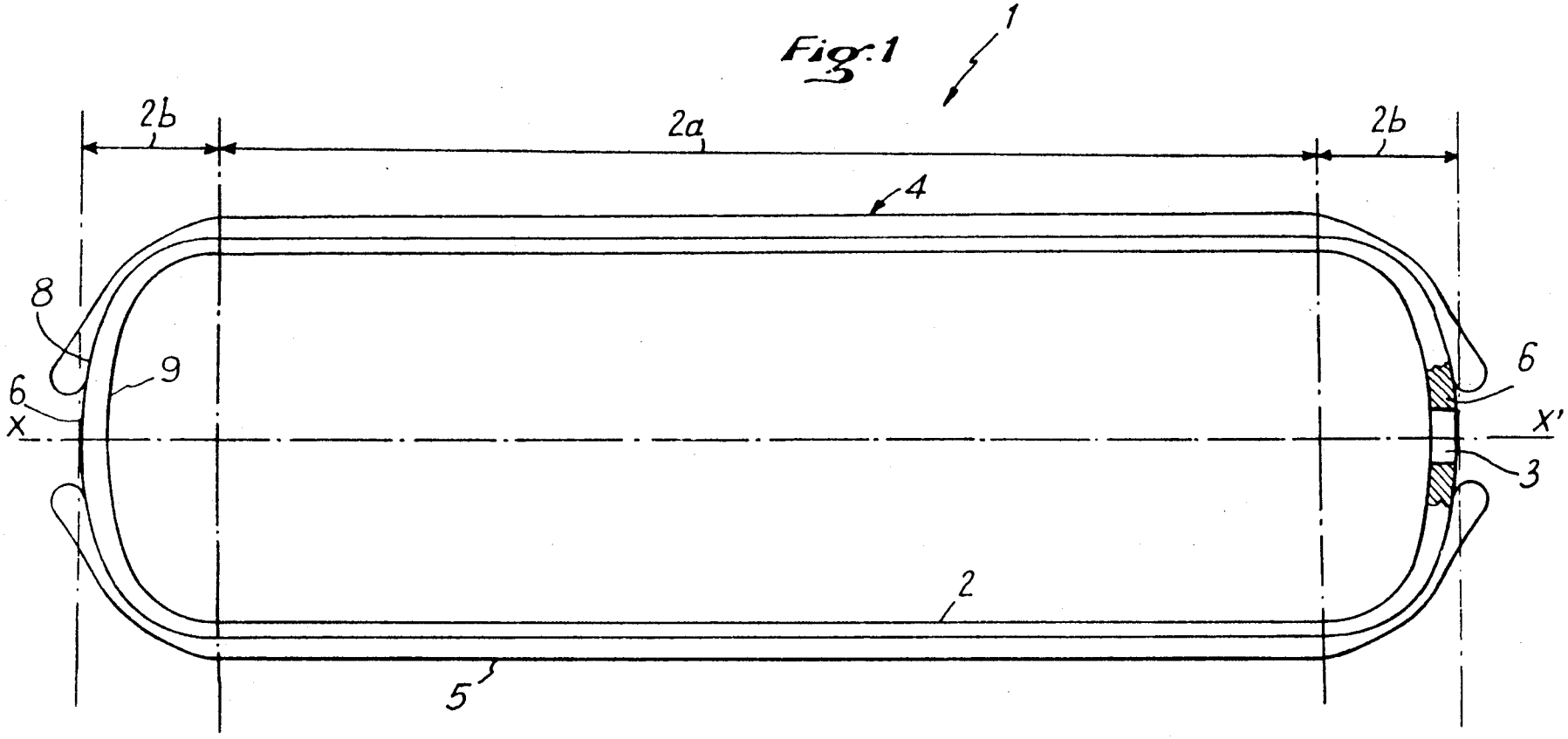
FIG. 1 is a longitudinal section view of a receptacle conforming to the invention.

With particular reference to FIG. 1, the receptacle 1 for the storage of fluid under pressure includes an internal casing 2, for example one made of aluminium, with a form of revolution around a longitudinal axis X, X' and having a central cylindrical section 2*a* and two extremity sections 2*b* bulging outwards. One of the extremity sections 2*b* shown at the right on FIG. 1 has an opening 3 or neck for the filling of the receptacle by a fluid. In addition, the receptacle 1 possesses an armouring 4 made up of resistant fibers (for example, glass, Kevlar (registered trade mark), carbon, boron) coated with a hardenable bonding material and encompassing the casing 2. For the purpose of clarity of the drawing, the armouring 4 shown on FIGS. 1 and 2 comprises a single planetary winding 5 leaving clear at the extremity sections 2*b* a cap 6 centered on the axis X, X'.

Figure 3:
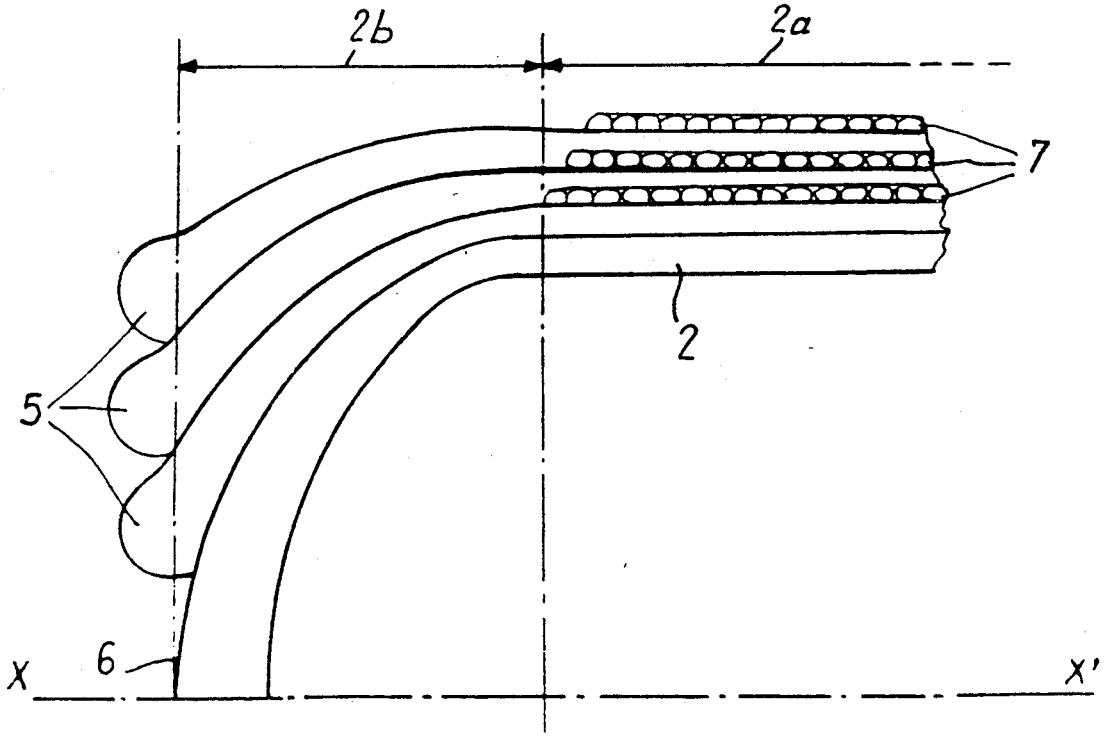
FIG. 3 is a view similar to that of FIG. 2 and showing an alternation of planetary windings and circumferential windings.

However and as shown on FIG. 3, the armouring 4 is advantageously generally constituted by an alternation of planetary windings 5 and circumferentail windings 7. Each of the latter is applied on the immediately lower planetary winding 5 in correspondence with the central cylindrical section 2*a* of the casing 2.

Figure 2:
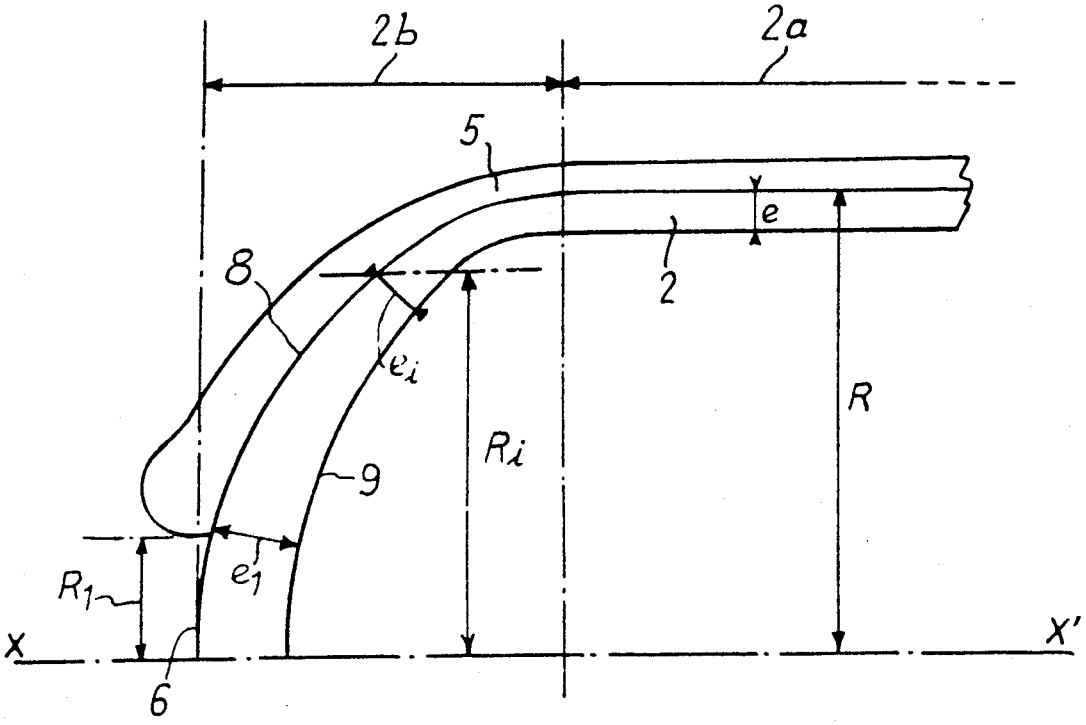
FIG. 2 shows on larger scale one convex extremity section of the receptacle of FIG. 1.

As already indicated and with reference more particularly to FIG. 2, according to the invention, the outer contour of the convex extremity sections 2*b* of the casing 2 has, as a longitudinal section, a shape which is at least approximately elliptical so that the ratio G of the half small axis to the major axis is such that $$0.32 \leqq G \leqq 0.4 \qquad \text{(I)}$$

where the major axis corresponds to the outer diameter of the central cylindrical section 2*a* of the casing 2, and the thickness $e_i$ of each convex extremity section 2*b* of the casing 2, said cap 6 being excluded, varies according to the formula:

$$e_i = \frac{e - e}{R - R1}(R - R_i) + e \qquad \text{(II)}$$

in which:

$R_i$=distance to the axis X, X' of the point of the outer contour 8 of said convex extremity section 2*b* at which the thickness $e_i$ is measured, e=thickness of the casing 2 at its central cylindrical section 2*a*, R=external radius of the central cylindrical section 2*a* of the casing 2, $R_1$=radius of the base of said cap 6, and $e_1$ thickness of the casing 2 for $R_i=R_1$, the thickness of said cap 6 being at least equal to $e_1$.

More particularly, said ratio G may be such that:

$$0.34 \leqq G \leqq 0.35$$

Furthermore, the internal contour 9 of each convex extremity section 2*b* of the casing 2 has, as a longitudinal section, a shape which is at least almost elliptical.

Figure 4:
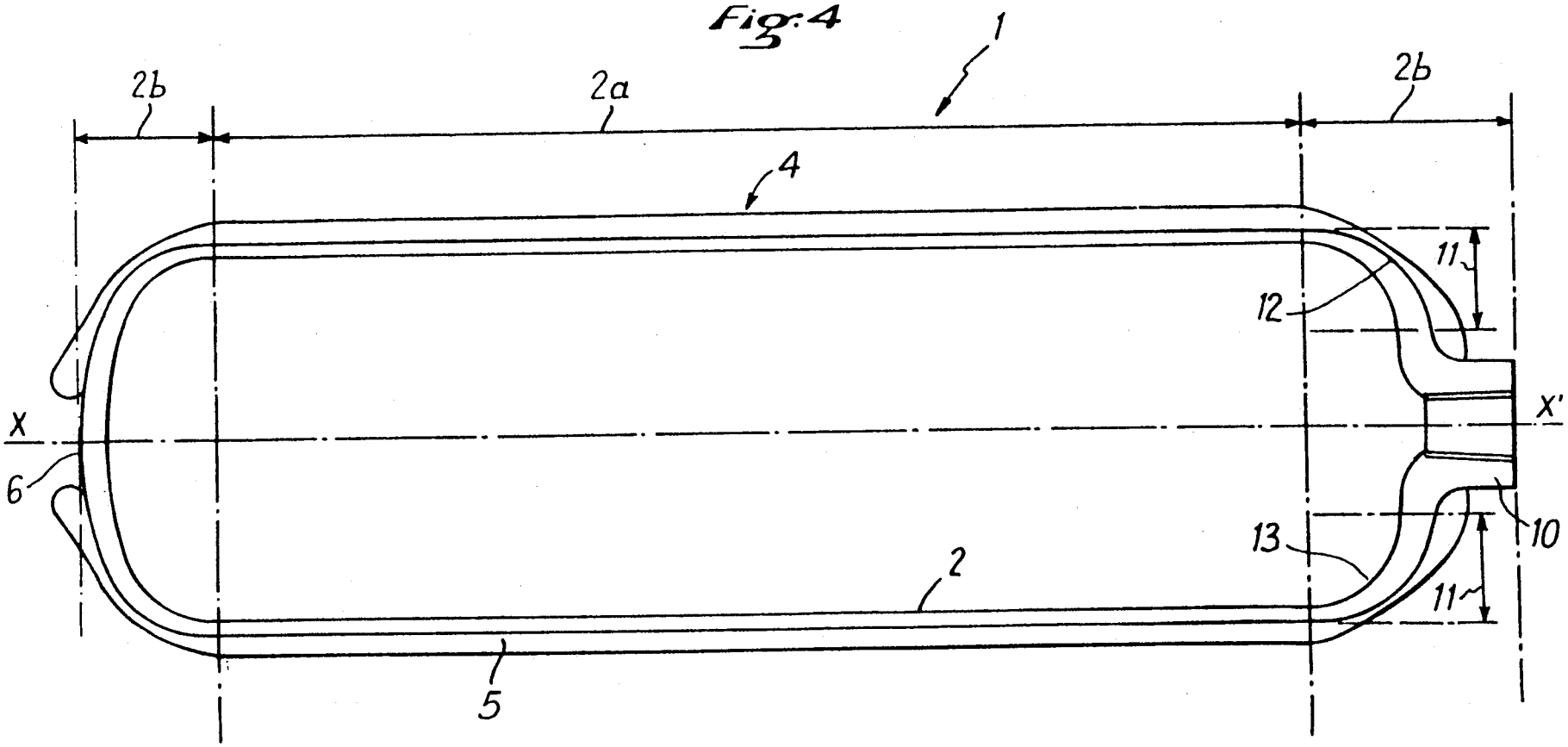
FIG. 4 is a view similar to that of FIG. 1 of a receptacle conforming to the invention and having a neck.

FIG. 4 shows another embodiment of the receptacle 1 conforming to the invention and in which one extremity section 2*b* bulged outwards has a neck 10, the planetary winding 5 of the armouring 4 resting on the neck 10.

In this case, on the periphery 11 of said extremity section 2*b*, the outer contour 12 of said extremity has, as a longitudinal section, a shape which is at least almost elliptical according to the formula (I) and, at least on said periphery 11, the thickness of said extremity section 2*b* varies according to the formula (II).

Furthermore, on the periphery 11 of said extremity section 2*b* containing the neck 10, the internal contour 13 of the latter has, as a longitudinal section, a shape which is at least approximately elliptical.

As already indicated, the invention applies more particularly to high-performance cylinders for the storage of gases, such as air, oxygen, nitrogen and carbon dioxide intended for the following sectors:

safety bodies (fire brigades, civil defence, hospitals. . .)

safety departments of industrial concerns, public services, oil tankers, large chemical and metal reinforcement plants, submarine activities, amateur and professional divers, submarines, miners, transportation, cylinders taken on board vessels.

What is claimed is:

1. Receptacle for the storage of fluid under pressure and of the type comprising an internal casing with a form of revolution around a longitudinal axis X, X' and having one central cylindrical section and two extremity sections, at least one of said extremity sections being bulged outwards so as to be a convex extremity, an armoring of resistant fibers coated with hardenable bonding material and encompassing said casing and having at least one planetary winding leaving open to said convex extremity section a cap centered on said axis X, X', wherein the outer contour of said convex extremity section of the casing has, as a longitudinal section, a shape which is at least approximately elliptical so that the ratio G of the small half axis to the major axis is such that:

$$0.32 \leqq G \leqq 0.4 \qquad \text{(I)}$$

where the major axis corresponds to the external diameter of the central cylindrical section of the casing and wherein the thickness $e_i$ of said convex extremity section of the casing, said cap being excluded, varies according to the formula:

$$e_i = \frac{e_1 - e}{R - R_1}(R - R_i) + e \qquad \text{(II)}$$

in which:

$R_i$=distance to the axis X, X' of the point of the outer contour of said convex extremity section at which the thickness $e_i$ is measured, e=thickness of the casing at its central cylindrical section, R=external radium of the central cylindrical section of the casing, $R_1$=radius of the base of said cap, and $e_1$=thickness of the casing for $R_i=R_1$, the thickness of said cap being at least equal to $e_1$.

2. Receptacle according to claim 1, wherein said ratio G is such that:

$$0.34 \leqq G \leqq 0.35$$

3. Receptacle according to claim 1, wherein the internal contour of said convex extremity section of the casing has, as a longitudinal section, a shape which is at least approximately elliptical.

4. Receptacle according to claim 1, wherein the two extremity sections bulge outwards, at least one of said sections being provided with a filler orifice.

5. Receptacle according to claim 4, wherein one extremity section of the casing has a neck and, at least on the periphery of said extremity section, the outer contour of the latter has, as a longitudinal section, a shape which is at least approximately elliptical according to the formula (I) and, at least on said periphery, the thickness of said extremity section varies according to the formula (II).

6. Receptacle according to claim 5, wherein, at least on the periphery of said extremity section containing the neck, the internal contour of the latter has, as a longitudinal section, a shape which is at least approximately elliptical.

7. Receptacle according to claim 5, wherein said armouring rests on said neck.

8. Receptacle according to claim 1, wherein said armouring comprises at least one circumferential winding on said planetary winding in correspondence with at least the central cylindrical section of the casing.

9. Receptacle according to claim 8, wherein said armouring is constituted by an alternation of planetary windings and circumferential windings.

10. Receptacle according to claim 1, wherein said casing is made of metal, such as aluminium.

* * * * *